US008453365B1

(12) United States Patent
Ballard

(10) Patent No.: US 8,453,365 B1
(45) Date of Patent: Jun. 4, 2013

(54) FIREARM WITH MOVABLE CHEEK RISER

(75) Inventor: Michael W. Ballard, Cerritos, CA (US)

(73) Assignee: Brookshire Tool & Mfg Co., Inc., South Gate, CA (US)

( * ) Notice: Subject to any disclaimer, the term of this patent is extended or adjusted under 35 U.S.C. 154(b) by 0 days.

(21) Appl. No.: 13/355,598

(22) Filed: Jan. 23, 2012

(51) Int. Cl.
*F41C 23/00* (2006.01)

(52) U.S. Cl.
USPC ..... 42/73; 42/71.01; 42/72; 42/74

(58) Field of Classification Search
USPC ..... 42/71.07, 72, 73, 74
See application file for complete search history.

(56) References Cited

U.S. PATENT DOCUMENTS

| | | | | | |
|---|---|---|---|---|---|
| 169,465 | A * | 11/1875 | Miller | 42/74 |
| 4,122,623 | A * | 10/1978 | Stice | 42/73 |
| 4,663,877 | A * | 5/1987 | Bragg | 42/74 |
| 4,896,446 | A * | 1/1990 | Gregory | 42/73 |
| 5,235,764 | A * | 8/1993 | Perazzi | 42/73 |
| 5,392,553 | A * | 2/1995 | Carey | 42/73 |
| 5,933,997 | A * | 8/1999 | Barrett | 42/73 |
| 5,970,642 | A * | 10/1999 | Martin | 42/73 |
| 7,793,453 | B1 * | 9/2010 | Sewell et al. | 42/73 |
| 7,810,270 | B2 * | 10/2010 | Fitzpatrick et al. | 42/73 |
| 7,984,580 | B1 * | 7/2011 | Giauque et al. | 42/73 |
| 8,186,090 | B1 * | 5/2012 | Chiarolanza et al. | 42/73 |
| 2008/0236016 | A1 * | 10/2008 | Fitzpatrick et al. | 42/71.01 |
| 2008/0236017 | A1 * | 10/2008 | Fitzpatrick et al. | 42/73 |

* cited by examiner

*Primary Examiner* — Michael Carone
*Assistant Examiner* — Derrick Morgan
(74) *Attorney, Agent, or Firm* — Bennet K. Langlotz; Langlotz Patent & Trademark Works, Inc.

(57) ABSTRACT

A firearm with movable cheek riser is a rifle stock having a stock body having a facility for receiving a rifle action and a rear extending portion, a stock butt portion telescopically connected to the rear extending portion, the butt portion being movable between a retracted position and an extended position, a cheek riser having a rear portion connected to the butt portion and a front portion connected to the stock body, and the cheek riser being movable between an elevated position and a lower position. The cheek riser may be pivotally connected to the butt portion. The cheek riser may include a downwardly-depending post received in a post bore defined in the stock body, wherein the post is curved such that a pivoting motion of the stock is facilitated. The invention may be a rifle including the rifle stock receiving a barreled rifle action.

17 Claims, 8 Drawing Sheets

FIREARM WITH MOVABLE CHEEK RISER

FIELD OF THE INVENTION

The present invention relates to firearms, and more particularly to a firearm having a movable cheek riser.

BACKGROUND OF THE INVENTION

The cheek riser is a device on a rifle stock that supports the shooter's cheek at a height suitable for use with the sights. High sights such as telescopic sights require higher cheek risers, and low sights such as iron sights require low cheek risers. Different users' preferences and physiology also suggests different riser heights for any given configuration.

These devices vary significantly between firearms, and various adjustable cheek risers are known. A traditional approach relies upon raising and lowering the entire cheek riser. An alternative pivoting approach is also known. However, conventional approaches to adjustable cheek risers that also allow for buttstock adjustability to change the length of pull require the cheek riser to either be removed or have its height adjusted.

Therefore, a need exists for a new and improved firearm with movable cheek riser that allows the length of pull to be adjusted without affecting the cheek riser. In this regard, the various embodiments of the present invention substantially fulfill at least some of these needs. In this respect, the firearm with movable cheek riser according to the present invention substantially departs from the conventional concepts and designs of the prior art, and in doing so provides an apparatus primarily developed for the purpose of allowing the length of pull to be adjusted without affecting the cheek riser.

SUMMARY OF THE INVENTION

The present invention provides an improved firearm with movable cheek riser, and overcomes the above-mentioned disadvantages and drawbacks of the prior art. As such, the general purpose of the present invention, which will be described subsequently in greater detail, is to provide an improved firearm with movable cheek riser that has all the advantages of the prior art mentioned above.

To attain this, the preferred embodiment of the present invention essentially comprises a rifle stock having a stock body having a facility for receiving a rifle action and a rear extending portion, a stock butt portion telescopically connected to the rear extending portion, the butt portion being movable between a retracted position and an extended position, a cheek riser having a rear portion connected to the butt portion and a front portion connected to the stock body, and the cheek riser being movable between an elevated position and a lower position. The cheek riser may be pivotally connected to the butt portion. The cheek riser may include a downwardly-depending post received in a post bore defined in the stock body, wherein the post is curved such that a pivoting motion of the stock is facilitated. The invention may be a rifle including the rifle stock receiving a barreled rifle action. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
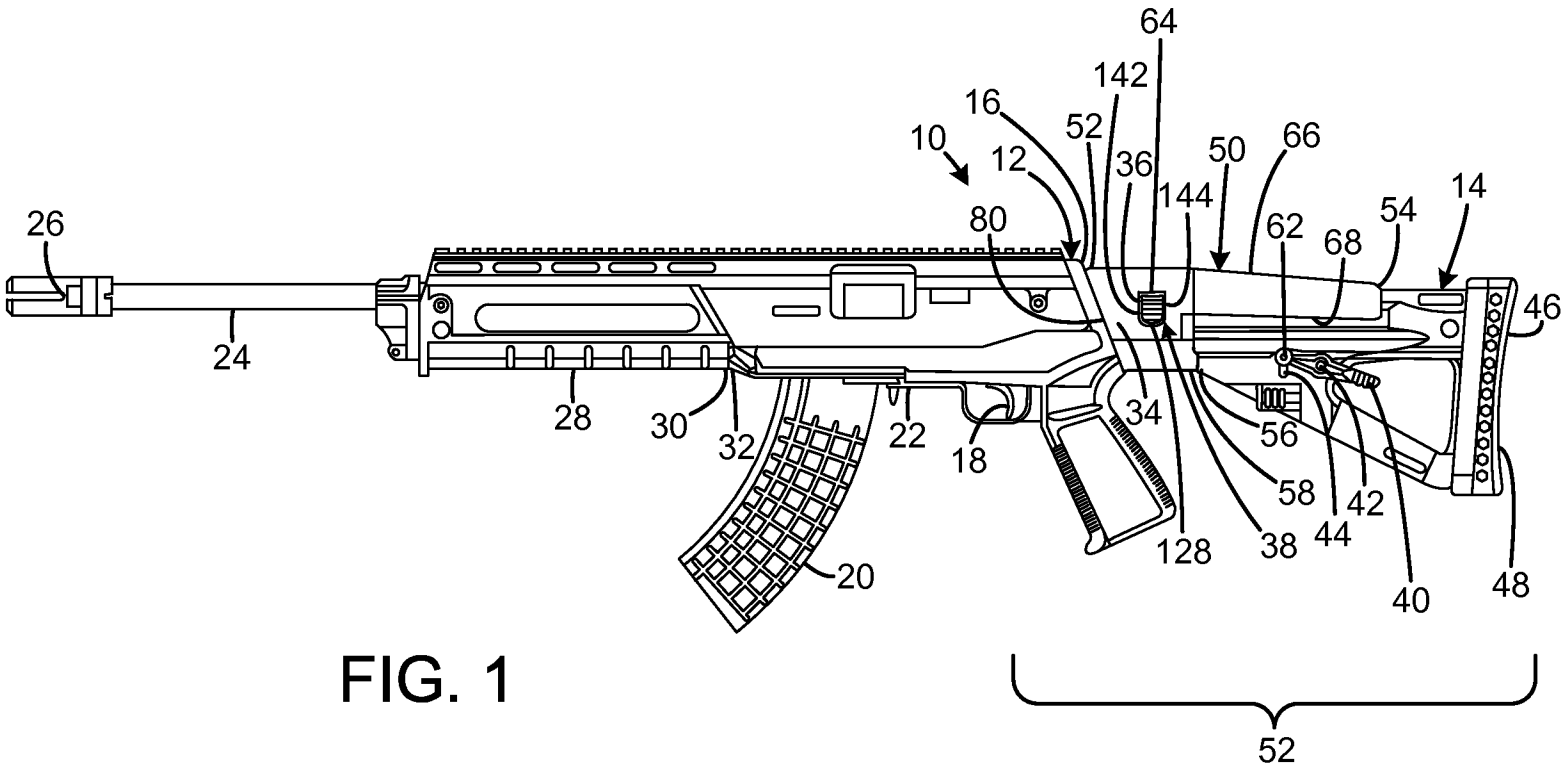
FIG. 1 is a left side view of the current embodiment of the firearm with movable cheek riser constructed in accordance with the principles of the present invention.

An embodiment of the firearm with movable cheek riser of the present invention is shown and generally designated by the reference numeral 10.

FIG. 1 illustrates the improved firearm with movable cheek riser 10 of the present invention. More particularly, the firearm is a rifle having an upper receiver 12 with a stock 14 extending rearward from the rear 16 of the upper receiver 12. A trigger 18 and a magazine 20 extend downwardly from the upper receiver's bottom 22. The rifle may be a Mini-14® or a Mini-Thirty® rifle manufactured by Sturm, Ruger & Company, Inc. of Southport, Conn. In alternative configurations employing the same concepts, rifle receivers of essentially any type may be employed.

The muzzle 26 end of a barrel 24 extends forwardly from the front 14 of the upper receiver 12. A hand guard 28 removably encircles the barrel with the hand guard's rear 30 abutting the front 32 of the upper receiver.

The front 80 of a stock 14 extends rearwardly from the rear 16 of the upper receiver 12 in the form of an I-beam 58. The rear 48 of the stock forms a butt portion 46. The distance between the trigger 18 and the butt portion 46 defines the firearm's length of pull 52. The length of pull is adjusted by pivoting the lever 40 counterclockwise about the pivot pin 42 to lower the guide pin 62 within the slot 44 to release the butt portion for slidable adjustment. In FIG. 1, the butt portion is shown in the forwardmost of four positions. In the illustrated position, the length of pull is minimized.

A portion of the stock between the butt portion and the upper receiver forms a cheek riser 50 having a front 52, a rear 54, a top 66, and a bottom 68. The left side 128 of a release button 38 located in a bore 36 in the left side 34 of the I-beam 58 is depressed to release the front of the cheek riser for height adjustment. In FIG. 1, the cheek riser is shown in the lowest of seven available positions.

Figure 2:
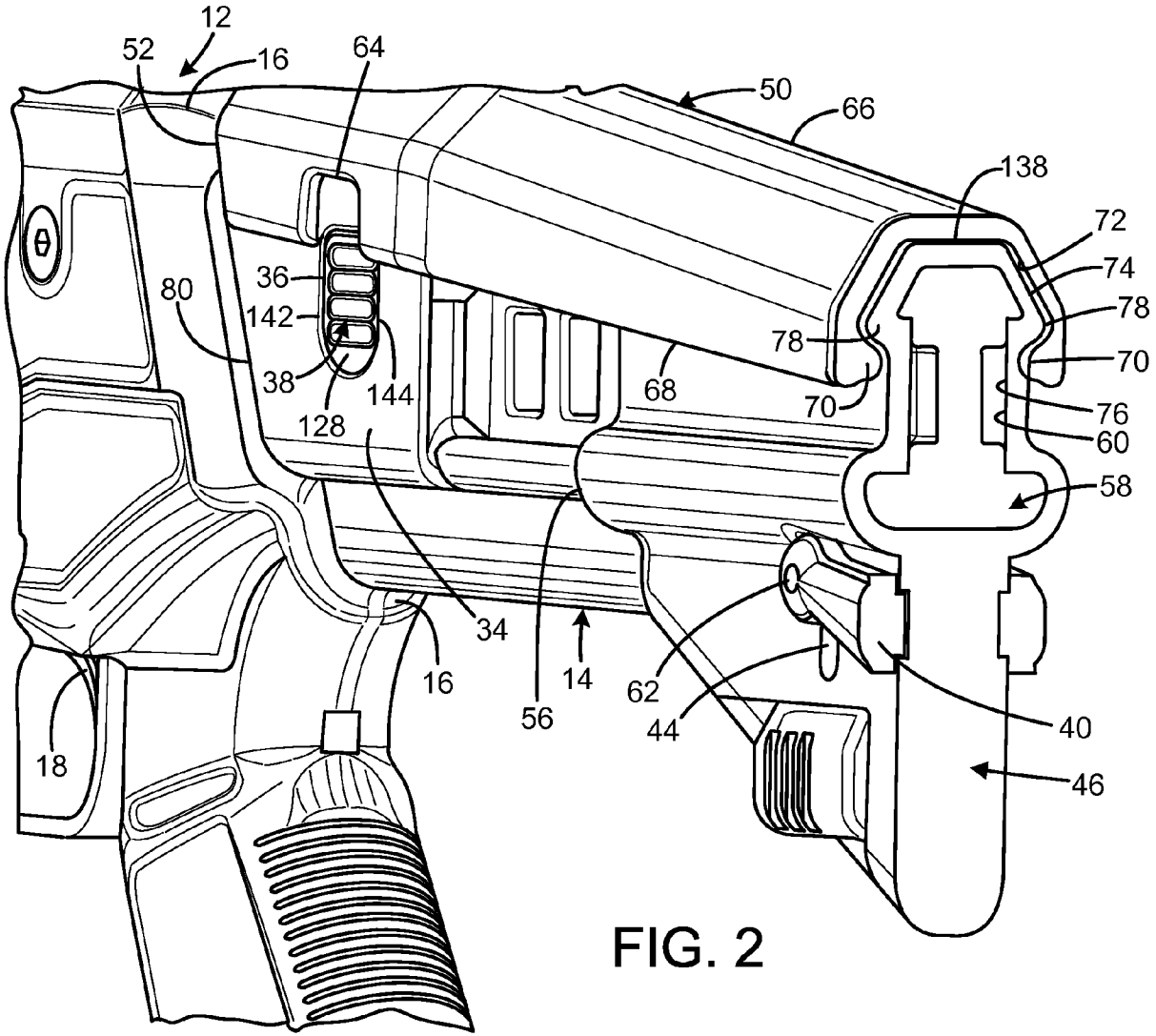
FIG. 2 is a rear sectional perspective view of the current embodiment of the firearm with movable cheek riser of FIG. 1 with the cheek riser raised and the butt portion extended rearward relative to the positions shown in FIG. 1.

FIG. 2 illustrates the improved firearm with movable cheek riser 10 of the present invention. More particularly, the front 52 of the cheek riser 50 has been raised and the butt portion 46 of the stock 14 has been slid rearwardly relative to the positions shown in FIG. 1. The rear 48 of the stock has been cut away so that the interior 72 of the cheek riser and the interior 76 of the butt portion are visible.

The interior 76 of the butt portion 46 receives the I-beam-portion 58 of the stock 14. The rear 54 of the cheek riser 50 is positioned above the top 138 of the exterior 74 of the butt portion. Two pivot bumps 70 formed by the bottom 68 interior 72 of the cheek riser ride underneath an overhang 78 that protrudes outwards from the butt portion. The pivot bumps limit both vertical and lateral movement of the cheek riser. The overhang limits upward movement of the rear of the cheek riser, which causes the front 52 of the cheek riser to pivot about the pivot bumps when the front of the cheek riser is raised and lowered. The butt portion is slidably mounted on the I-beam and below the cheek riser so the butt portion can telescopically adjust to change the length of pull 52 without removing the cheek riser or changing the adjustment height of the cheek riser.

Figure 3:
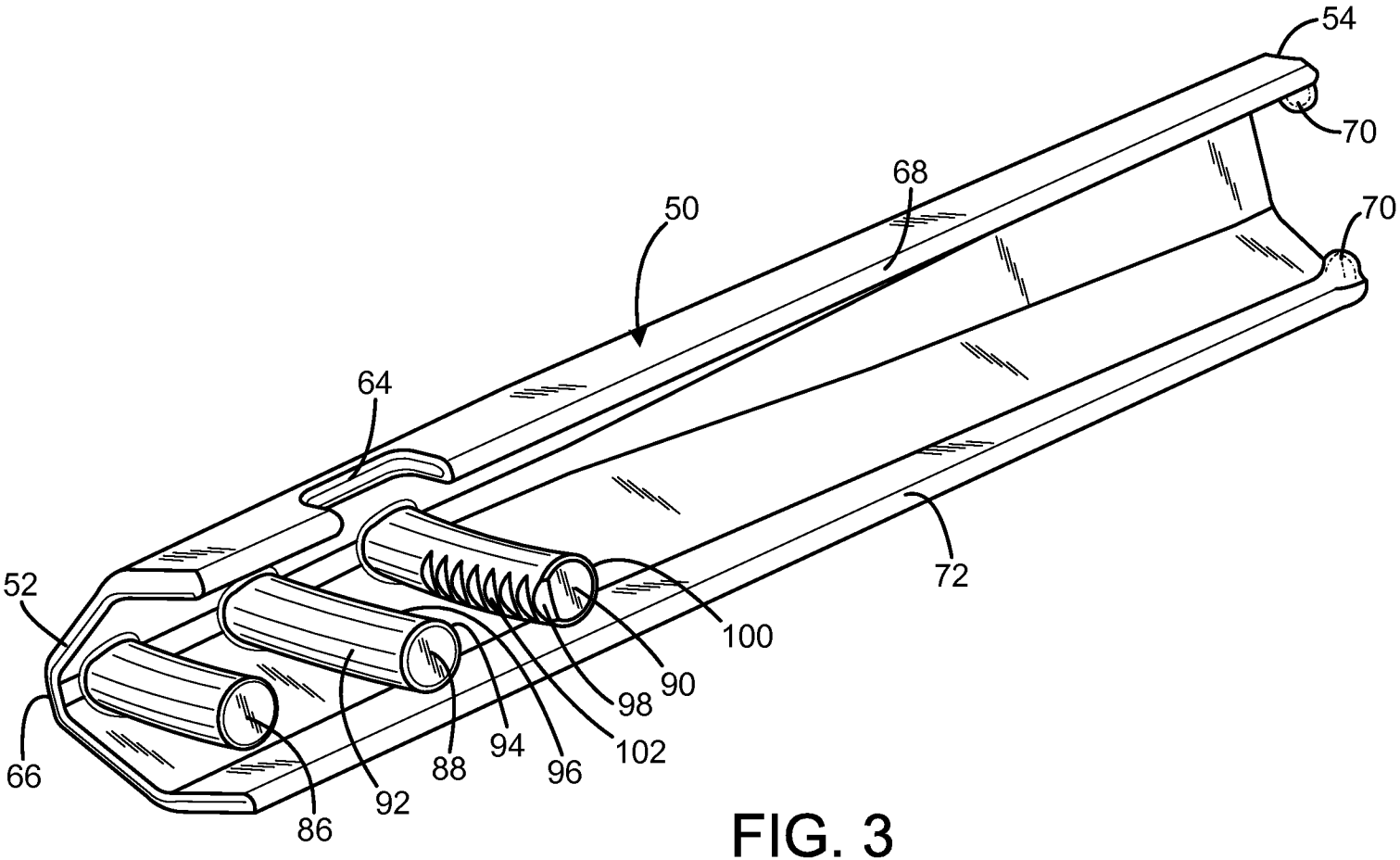
FIG. 3 is a bottom perspective view of the current embodiment of the cheek riser removed from the firearm of FIG. 1.

FIG. 3 illustrates the cheek riser 50. More particularly, the cheek riser has three posts 86, 88, 90 that protrude downwards within the interior 72 from the front 52 of the top 66 of the cheek riser. The rear 54 of the cheek riser forms to substantially spherical pivot bumps 70 within the bottom 68 of the interior. The left side of the cheek riser defines a slot 64 that facilitates access to the left side 128 of the release button 38 when the cheek riser is in its lower adjustment positions.

Each of the posts 86, 88, 90 is a toroidal segment with a radius of curvature centered on the pivot bumps 70 to compensate for the pivotal motion of the cheek riser 50 about the pivot bumps when the front 52 of the cheek riser is raised and lowered. The front post 86 is smooth. The middle post 88 has a smooth front 92, but forms teeth 96 on its rear 94. The rear post 90 forms teeth 100 to on its front 98, but has a smooth rear 100. The teeth 96, 100 are cut laterally straight through the posts. The purpose of the teeth on the posts will be explained in more detail in the discussion of FIGS. 4A-6. Three posts are used to provide structural strength while enabling each post to be narrow, which allows the assembly to have a desirable degree of compactness.

Figure 4A:
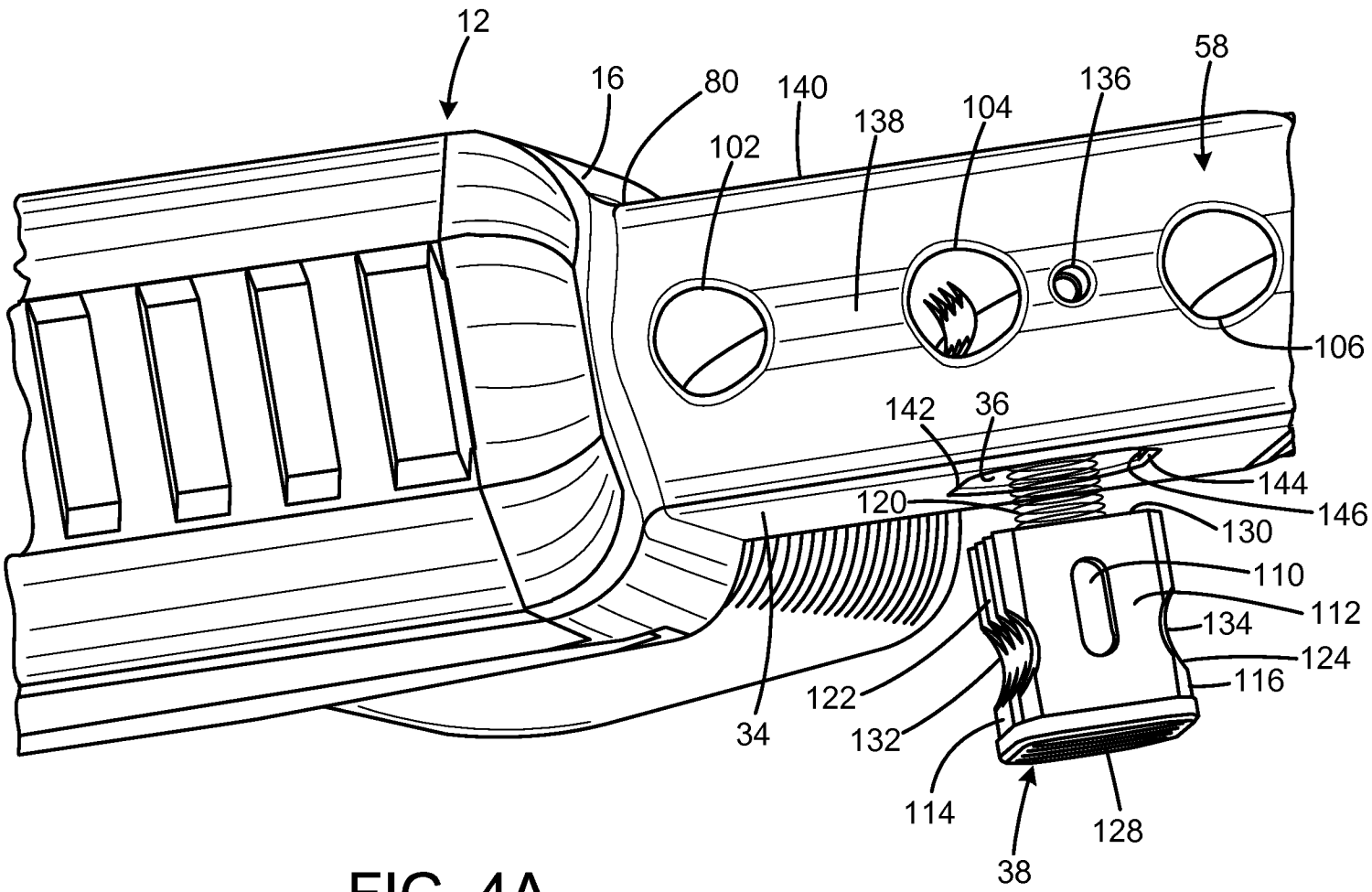
FIG. 4A is a top perspective exploded partial view of the current embodiment of the upper receiver and I-beam with the cheek riser removed.
Figure 4B:
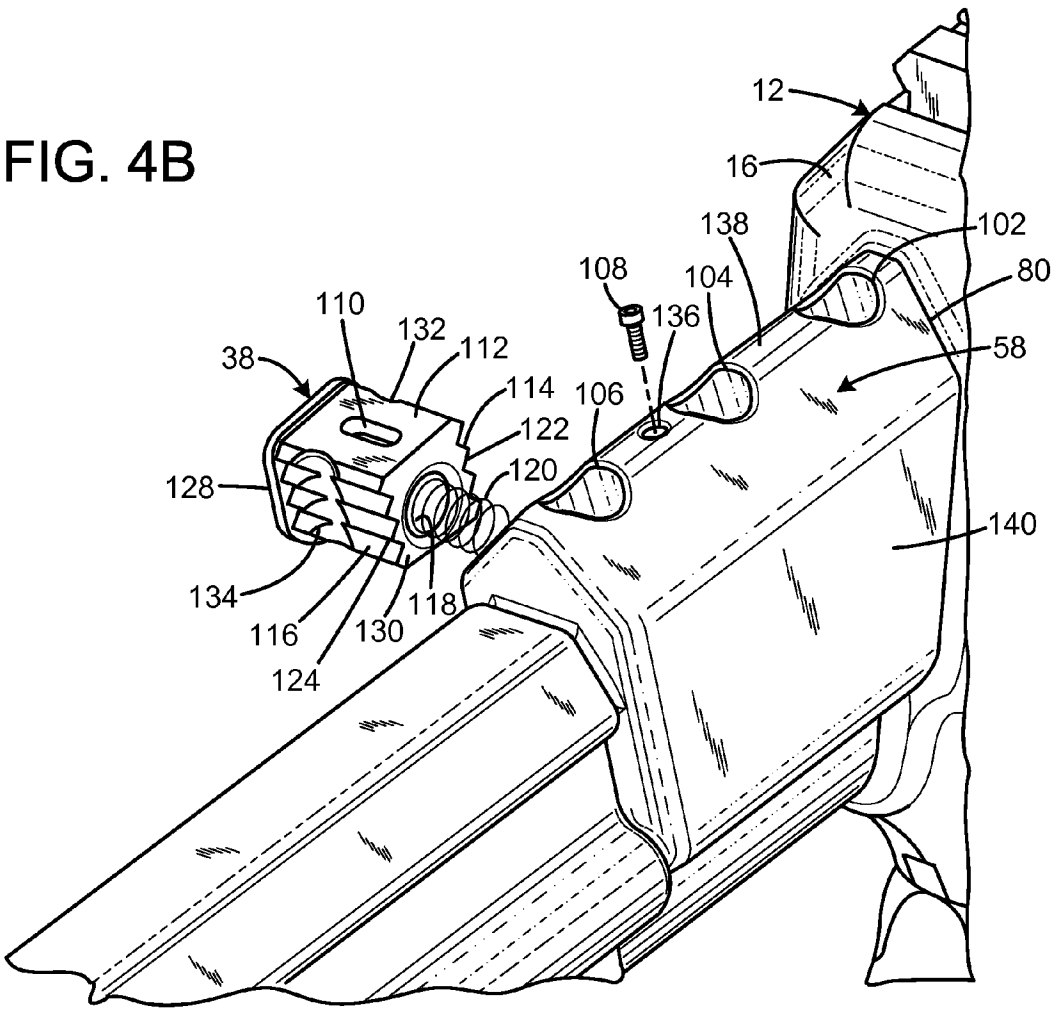
FIG. 4B is a right side perspective exploded partial view of the current embodiment of the upper receiver and I-beam with the cheek riser removed.
Figure 4C:
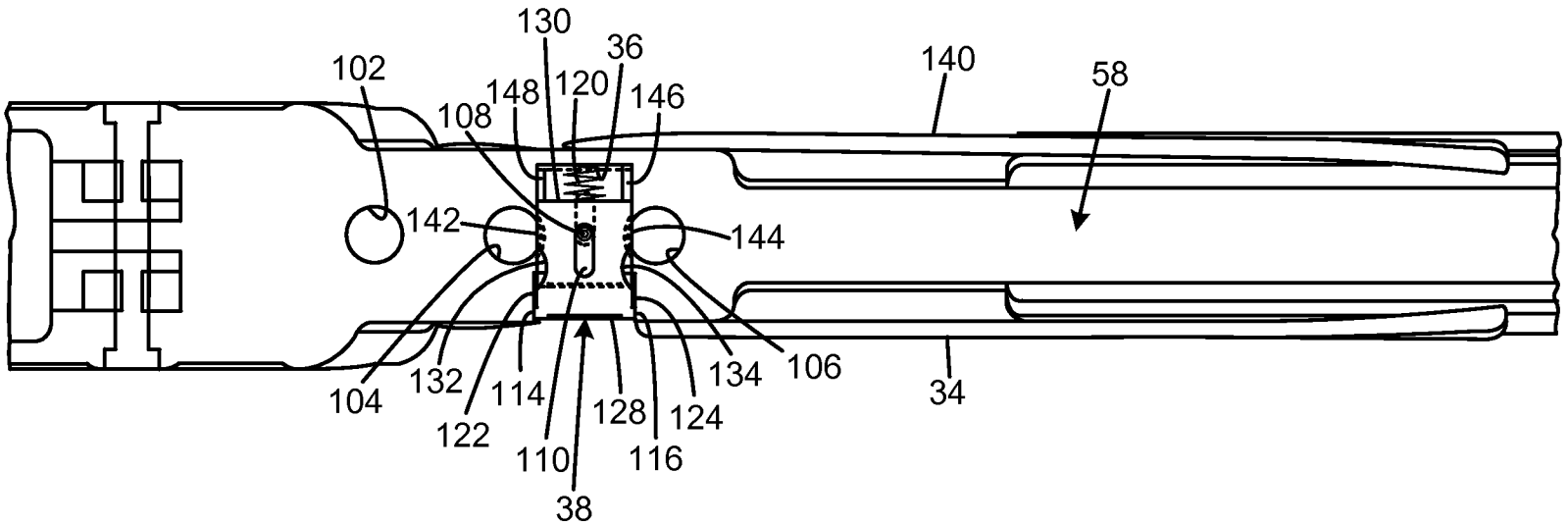
FIG. 4C is a top partial view of the current embodiment of the upper receiver and I-beam with the cheek riser removed.

FIGS. 4A-C illustrate the rear portion of the upper receiver 12 and the front portion of the I-beam 58. More particularly, the top 138 front 80 portion of the I-beam defines three post bores 102, 104, 106 and a retaining screw hole 136. The front post bore 102 is axially registered with the front post 86 of the cheek riser 50. The middle post bore 104 is axially registered with the middle post 88 of the cheek riser. The rear post bore 106 is axially registered with the rear post 90 of the cheek riser. The post bores are also toroidal segments with a radius of curvature centered on the pivot bumps 70 to compensate for the pivotal motion of the cheek riser 50 about the pivot bumps when the front 52 of the cheek riser is raised and lowered.

The bore 36 in the left side 34 of the I-beam is located between the middle post bore and the rear post bore and enables communication between those two bores. The retaining screw hole also communicates with the bore 36. The front 142 and rear 144 of the bore 36 define front teeth 148 and rear teeth 146. The middle and rear post bores cut off the front teeth 148 and rear teeth 146 where the bores intersect them.

The bore 36 receives the release button 38. The release button has a top 112, front 114, rear 116, left side 128, and right side 130. The front defines teeth 122, and the rear defines teeth 124. When the release button is received within the bore 36, the teeth 122, 124 mesh with the teeth 146 in the front 142 and rear 144 of the bore 36. A semi-cylindrical bore is made in both the front and rear to remove the teeth and create free movement areas 132, 134. The free movement areas have the same diameter as the middle and rear post bores 104, 106. The right side defines a spring hole 118 that receives a spring 120. The spring biases the left side 128 of the release button outwards from the left side 34 of the I-beam 58 so that the teeth in the front and the rear of the release button are located within the middle and rear post bores.

The spring hole 118 enables the spring 120 to fully collapse inside the release button 38 when the release button is depressed, which enables the free movement areas 132, 134 to axially align with the middle and rear post bores 104, 106. When the free movement areas are axially aligned with the middle and rear post bores, the teeth 122, 124 in the front 114 and rear 116 of the release button are no longer present within the middle and rear post bores.

The top 112 of the release button 38 defines a retaining screw slot 118. When the release button is received within the bore 36, the retaining screw slot is aligned with the retaining screw hole 136 in the top 138 of the I-beam 58. A retaining screw 188 screwed into the retaining screw hole protrudes downwards into the retaining screw slot. The retaining screw limits lateral movement of the release button to retain the release button within the bore 36. The retaining screw also acts as a limit stop when the release button is depressed inwards toward the right side 140 of the I-beam.

Figure 5:
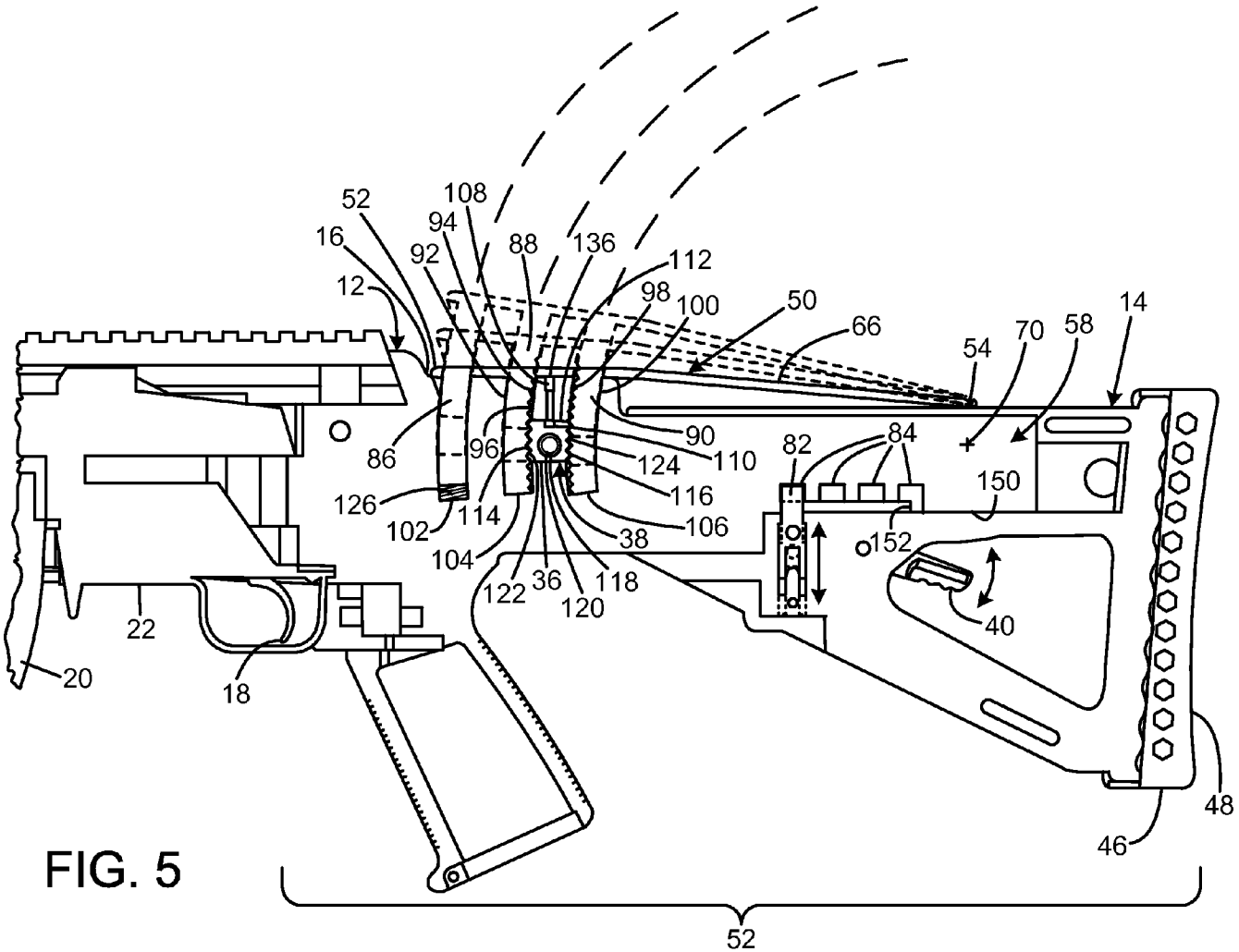
FIG. 5 is a left side sectional partial view of the current embodiment of the upper receiver and stock.
Figure 6:
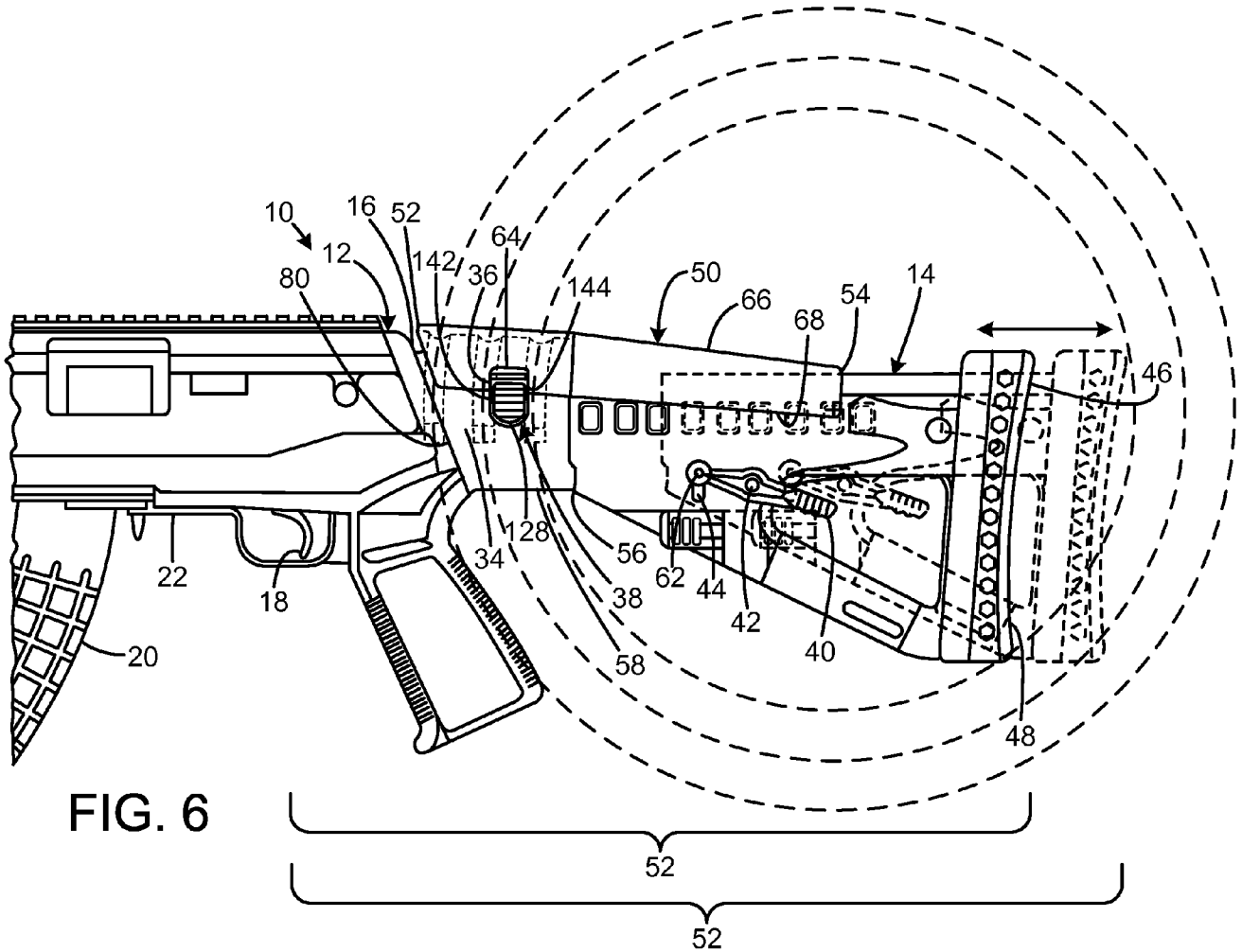
FIG. 6 is a left side partial view of the current embodiment of the upper receiver and stock.

FIGS. 5-6 illustrate the rear portion of the upper receiver 12 and the stock 14. More particularly, the adjustability of the cheek riser 50 and butt portion 46 are depicted.

The pivotal motion of the cheek riser 50 about the pivot bumps 70 when the front 52 is raised and lowered is denoted by the dashed lines. Normally the middle and rear posts 88, 90 are secured within the middle and rear bores 104, 106 by engagement of teeth 96, 102 with the teeth 122, 124 in the front 114 and rear 116 of the release button 38. However, when the release button is depressed within the bore 36 to the limit established by the retaining screw 188, the axial alignment of the free movement areas 132, 134 with the middle and rear post bores disengages teeth 96, 102 from the teeth 122, 124. This disengagement permits raising or lowering of the front of the cheek riser to the desired height. An assist spring 126 in the front post bore 102 facilitates raising of the cheek riser when the cheek riser has been adjusted to the lowest position. When the release button is fully depressed in the bore 36, the assist spring pushes the cheek riser moves upward approximately ¼ inch to facilitate adjustment of the cheek riser.

FIG. 5 shows the lowermost position of the cheek riser in solid lines and the middle and highest adjustment positions of the cheek riser in dashed lines. The other four adjustment positions of the cheek riser are not illustrated. In the current embodiment, the quantity and spacing of the teeth allow seven different height settings in ⅛ inch increments. However, the lengths of the posts and post bores, the quantity of teeth, and the spacing of the teeth can be varied to enable different quantities of height settings and increments. If lines are drawn between opposed teeth, the lines converge on the pivot point defined by the pivot bumps 70. The teeth pitch is greater in the front and lesser in the rear so pivoting is permitted. The pitch of both the front and the rear teeth is proportional to the distance of the teeth from the pivot point.

The telescoping motion of the butt portion 46 of the stock 14 on the I-beam 58 is denoted by the double headed arrow in FIG. 6. Normally, a spring (not shown) biases the lever 40 so that a retention pin 82 is secured within one of four bores 84 in the bottom 150 of the I-beam 58. However, when the lever is pivoted counterclockwise, the retention pin 82 is lowered sufficiently to clear the bores 84. This clearance permits the butt portion to slide forward or rearward to the extent permitted by the slot 152 in the bottom of the I-beam 58. Slot 152 prevents inadvertent removal of the butt portion from the I-beam. FIG. 6 shows the butt portion in the position that minimizes the length of pull 52 in solid lines and the most rearwardly extended position that maximizes the length of pull in dashed lines. The other two adjustment positions of the butt portion are not depicted.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a firearm with movable cheek riser has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rifle stock having a movable cheek riser comprising:

a stock body having a facility for receiving a rifle action;

the stock body having a rear extending portion;

a stock butt portion telescopically connected to the rear extending portion;

the butt portion movable between a retracted position and an extended position;

a cheek riser having a rear portion pivotally connected to the butt portion, and a front portion directly connected to the stock body; and the cheek riser movable between an elevated position and a lowered position.

2. The rifle stock of claim 1 wherein the cheek riser includes a downwardly-depending post received in a post bore defined in the stock body, and wherein the post is curved, such that a pivoting motion of the cheek riser is facilitated.

3. The rifle stock of claim 2 wherein the cheek riser includes a pivot element constrained by the butt position, and wherein the post is curved on a radius centered on the pivot element, such that the post may freely move within the bore when the riser pivots about the pivot element.

4. The rifle stock of claim 2 wherein the post bore is curved to closely receive the post.

5. The rifle stock of claim 1 wherein the butt portion defines a channel, and wherein the cheek riser includes a pivot element received in the channel, such that the butt portion may be telescopically moved with respect to the stock body while the cheek riser is secured in position.

6. The rifle stock of claim 1 wherein the cheek riser is connected to the stock body in a manner constraining axial motion of the riser, and is connected to the butt portion in a manner constraining vertical motion of the riser.

7. The rifle stock of claim 1 wherein the stock body defines a plurality of upwardly-open post bores, and wherein the cheek riser includes a plurality of downwardly-depending posts, each closely received in a corresponding post bore.

8. The rifle stock of claim 7 wherein two of the posts have contoured surfaces having engagement surfaces, and wherein a latch element is received within a latch bore in the stock body, and latch bore being positioned between the bores associated with the two of the posts, such that the latch may selectably engage the engagement surfaces to retain the riser in a selected position.

9. The rifle stock of claim 8 wherein the contoured surfaces on each post include a repeating pattern of engagement surfaces, each corresponding to a selected position of the riser.

10. The rifle stock of claim 9 wherein the contoured surfaces of one post are spaced at a first pitch, and the contoured surfaces of the other post are spaced at a different second pitch.

11. The rifle stock of claim 10 wherein the pitch of the contoured surfaces is proportional to the distance of the contoured surfaces from a selected pivot point on the riser.

12. The rifle stock of claim 1 wherein the riser is an elongated body defining an inward facing channel defined between opposed side walls.

13. The rifle stock of claim 12 wherein the riser includes opposed pivot bumps protruding from opposed rear portions of inward facing faces of the sidewalls.

14. The rifle stock of claim 12 wherein the riser includes a post depending downward from a forward portion of the riser, medial between the sidewalls.

15. The rifle stock of claim 14 wherein including a plurality of downwardly depending posts arranged in a common vertical plane medial between the sidewalls.

16. The rifle stock of claim 12 wherein the butt portion includes a latch operable to engage the stock body in a plurality of different extension positions, and further defines a pair of opposed elongated channels, each receiving one of the pivot bumps.

17. A rifle comprising the rifle stock of claim 1 receiving a barreled rifle action.

* * * * *